US011342134B2

(12) United States Patent
Ruff

(10) Patent No.: US 11,342,134 B2
(45) Date of Patent: May 24, 2022

(54) KEY MODULE FOR A KEYBOARD, AND KEYBOARD

(71) Applicant: Cherry GmbH, Auerbach/Opf (DE)

(72) Inventor: Eduard Ruff, Auerbach (DE)

(73) Assignee: CHERRY GMBH, Auerbach/Opf (DE)

( * ) Notice: Subject to any disclaimer, the term of this patent is extended or adjusted under 35 U.S.C. 154(b) by 0 days.

(21) Appl. No.: 16/967,817

(22) PCT Filed: Jul. 27, 2018

(86) PCT No.: PCT/EP2018/070385

§ 371 (c)(1),
(2) Date: Aug. 6, 2020

(87) PCT Pub. No.: WO2019/154529

PCT Pub. Date: Aug. 15, 2019

(65) Prior Publication Data

US 2020/0381190 A1 Dec. 3, 2020

(30) Foreign Application Priority Data

Feb. 6, 2018 (DE) ..... 10 2018 102 609.9

(51) Int. Cl.
*H01H 3/12* (2006.01)
*H01H 13/70* (2006.01)
(Continued)

(52) U.S. Cl.
CPC ..... *H01H 3/125* (2013.01); *H01H 13/7013* (2013.01); *H01H 13/7073* (2013.01); *H01H 13/78* (2013.01)

(58) Field of Classification Search
CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507; H01H 13/7013; H01H 13/7073
See application file for complete search history.

(56) References Cited

U.S. PATENT DOCUMENTS 5,372,442 A * 12/1994 Wang ..... B41J 5/16 200/341
2001/0007301 A1* 7/2001 Sato ..... H01H 3/122 200/344

(Continued)

*Primary Examiner* — Ahmed M Saeed
(74) *Attorney, Agent, or Firm* — James R. Hayne; Stites & Harbison PLLC

(57) ABSTRACT

What is presented is a key module (120) for a keyboard. The key module (120) comprises a guide (230) for guiding a movement of the key module (120) upon actuation, at least one spring element (240) for providing a reset force upon actuation of the key module (120), a support element (250) for supporting the guide (230) and a switch unit. The switch unit comprises a housing (270) and a contact device (280) at least partially arranged in the housing (270) for establishing electric contact upon actuation of the key module (120). The contact device (280) comprises a fixed contact piece with a first contact and a contactor with a first spring clip carrying a second contact and/or a second spring clip for producing an actuation sound and/or at least one actuation portion. The contactor is integrally formed.

13 Claims, 10 Drawing Sheets

(51) Int. Cl.
*H01H 13/7073* (2006.01)
*H01H 13/78* (2006.01)

(56) References Cited

U.S. PATENT DOCUMENTS

2017/0178841 A1* 6/2017 Hsu ..... H01H 3/12
2018/0284904 A1* 10/2018 Chen ..... H01H 13/78
2018/0294111 A1* 10/2018 Su ..... H01H 13/14

* cited by examiner

KEY MODULE FOR A KEYBOARD, AND KEYBOARD

The present invention relates to a key module for a keyboard and to a keyboard with at least one such key module.

In keyboards, such as ones used in connection with computers, for example, various key systems may be employed.

EP 1 612 821 A2 discloses a key switch, a keyboard and a key-switch assembling jig.

Against this background, the present invention provides an improved key module for a keyboard and an improved keyboard in accordance with the main claims. Preferred embodiments are defined in the dependent claims and the subsequent description.

According to embodiments of the approach described here, a switch unit or switching mechanism may be provided for a key module, wherein an electrical contact may be established and optionally also an actuation sound may be produced by means of such a switch unit. For example, the switch unit may enable the function of establishing the electrical contact and optionally also the acoustic feedback. In particular, this may be realized by way of an integrally formed contactor with at least one spring clip. Moreover, for example, the switch unit, in conjunction with a suitable guide unit of the key module, may also be configured to provide a reset force with respect to actuation of the key module and additionally or alternatively a specific force-path characteristic and to make the same adjustable.

Advantageously, a very flat mechanical switch module can be provided, for example for gaming applications, high-end office applications and the like. For example, the switch module may be employed in notebooks and flat keyboards. The electrical contact may be established in a reliable manner, wherein the force-path characteristic of actuation can be influenced by suitably designing the contact device. In addition, an actuation sound may optionally also be realized easily. In particular, the switch unit may enable the electric function and optionally also the acoustic function by means of the contactor. For example, such a key module may fulfil requirements concerning very flat construction dimensions, such as block dimensions of 1 to 4 millimeters, particularly of up to about 2 millimeters. It can also be achieved that the life of the key module may lie in the range of classic mechanical key modules, for example.

A key module for a keyboard is presented, wherein the key module comprises:

a guide for guiding a movement of the key module upon actuation;

a support element for supporting the guide; and a switch unit, wherein the switch unit comprises a housing and a contact device at least partially arranged in the housing for establishing electric contact upon actuation of the key module, wherein the contact device comprises a fixed contact piece with a first contact and a contactor with a first spring clip carrying a second contact and additionally or alternatively a second spring clip for producing an actuation sound and additionally or alternatively at least one actuation portion, wherein the contactor is integrally formed.

The keyboard may be provided for a computer or the like, for example. The keyboard may comprise at least one key module. The key module may be part of a key or may represent a key. Hence, there may be provided one key module per key. The key module may also be referred to as a mechanical pushbutton. The housing may comprise at least one wall or a wall portion. The housing may be formed as a hood, a cage or the like. The housing may comprise one part or multiple parts. The at least one actuation portion may be pressed by a top part of the key or an auxiliary actuator. The electrical contact between the first contact and the second contact may be established in one contact point. Each contact may be formed to be elongated and additionally or alternatively may comprise a linear contact area. A contact area of the first contact and a contact area of the second contact may cross each other. Each contact area may extend obliquely with respect to a longitudinal axis of extension of the first spring clip. The second spring clip may comprise an actuation portion which is angled, bent or curved. The second spring clip may be formed to produce the actuation sound upon rebound against the housing or another component.

According to an embodiment, the contactor of the contact device may comprise the first spring clip, which carries the second contact, and the at least one actuation portion. Such an embodiment offers the advantage that a reliable and robust switch unit with an electric function can be realized in a constructively simple way without affecting costs.

As an alternative, the contactor of the contact device may comprise the first spring clip, which carries the second contact, the second spring clip for producing the actuation sound and the at least one actuation portion. Such an embodiment offers the advantage that a reliable and robust switch unit with an electric function and an acoustic function can be realized in a constructively simple way without affecting costs.

According to an embodiment, the housing may comprise an actuation opening for exposing the at least one actuation portion of the contact device. Additionally or alternatively, the housing may comprise a deflecting portion for deflecting the second spring clip contact device upon the actuation of the key module. The deflecting portion may formed obliquely inclined relative to the movement of the key module upon the actuation. The deflecting portion may be curved, slightly stepped, formed as a burl or a cam or the like. The deflecting portion may be formed to cause, upon the actuation of the key module, deflection or excursion of the second spring clip transversally or obliquely with respect to the movement of the key module upon the actuation. An angle of inclination of the deflecting portion relative to the movement of the key module upon the actuation may here be smaller than an angle of inclination of an angled or bent actuation portion of the second spring clip. Such an embodiment offers the advantage that easy and reliable actuation of the contact device can be enabled through the actuation opening. Additionally or alternatively, defined and low-friction deflection or excursion of the second spring clip can be achieved in order to cause a rebound of the second spring clip for the purpose of noise production.

Also, the key module may comprise an auxiliary actuator for actuating the contact device. The housing may comprise at least one holding portion for holding the auxiliary actuator. The auxiliary actuator may comprise at least one attaching portion for movably attaching the auxiliary actuator to the at least one holding portion of the housing. Additionally or alternatively, the auxiliary actuator may comprise at least one nose for deflecting the first spring clip and additionally or alternatively the second spring clip of the contact device upon the actuation of the key module. Using the holding portion and the attaching portion, movable attachment of the auxiliary actuator to the housing may be effected, wherein the movable attachment may be articulated or translational, for example. The second spring clip may be formed to produce the actuation sound upon rebound against the auxiliary actuator. The auxiliary actuator may comprise a nose for deflecting the first spring clip and additionally or alternatively the second spring clip or at least a first nose for deflecting the first spring clip and a second nose for deflecting the second spring clip. Such an embodiment offers the advantage that the contact device can be actuated in a robust and easy manner, wherein a variant of the contactor with one spring clip or two spring clips can be taken into account inexpensively in terms of construction.

Furthermore, the auxiliary actuator may comprise at least one fixing portion for fixing the auxiliary actuator to the first wing element or to the second wing element. The auxiliary actuator may be taken or moved along over the at least one fixing portion by at least one of the wing elements in at least one direction of movement upon the actuation of the key module. The at least one fixing portion may be formed as a protrusion. Such an embodiment offers the advantage that electric contact can be established and additionally or alternatively the actuation sound can be produced integrally in a reliable and robust manner upon the actuation of the key module. Furthermore, this can be achieved using a minimum amount of components and in a simple manner in terms of construction.

Moreover, the contact device may comprise soldering areas or connector pins for attaching the switch unit to a circuit substrate of the keyboard. Additionally or alternatively, the contact device may be formed to establish the electric contact while producing friction between the first contact and the second contact. Such an embodiment offers the advantage that contact deterioration due to contamination by particles can be avoided.

Also, the housing may formed of a transparent or opaque material and additionally or alternatively as at least one lens in at least a subsection. Additionally or alternatively, the housing may comprise a receiving bay for a light source. Additionally or alternatively, at least one groove for accommodating, in an actuated state of the key module, at least a subsection of at least one spring element for providing a reset force upon actuation of the key module may be formed in the housing. The at least one groove may also be referred to as a depressed portion, an oblong depression or a notch. The at least one lens may be configured to distribute light from a light source over the top part of the key module and additionally or alternatively over the keycap. The at least one lens may be configured to focus or scatter light. For example, the at least one lens may be an optical diffuser. Such an embodiment offers the advantage that illumination of the key can be achieved in a space-saving manner, and additionally or alternatively space for the key module can be saved due to the at least one spring element at least partially plunging into the groove. Moreover, the key module may support uniform and economical illumination of a keycap or part by means of a light source or a light source capable of being integrated.

According to an embodiment, the support element may comprise soldering surfaces or connector pins for attaching the support element to a circuit substrate of the keyboard. Additionally or alternatively, the support element may be formed of a metal material. Such an embodiment offers the advantage that direct attachment of the key module two a circuit board or the like can be enabled. Furthermore, the support element can be made robust.

In particular, the guide may comprise a first wing element and a second wing element. Each wing element may comprise a bar, a first arm and a second arm. The arms may extend away from the bar. A mounting portion may be formed on the bar. A first bearing portion for bearing the wing element may be formed on the first arm. A second bearing portion for bearing the wing element may be formed on the second arm. The first wing element and the second wing element may be mechanically coupleable to each other. Furthermore, at least one spring element for providing a reset force upon actuation of the key module may be mountable to the mounting portion of the first wing element and the mounting portion of the second wing element. A plurality of accommodating portions for accommodating the bearing portions of the wing elements may be formed in the support element. The accommodating portions of the support element may be formed as bearing grooves, notches or the like. In other words, the accommodating portions of the support element may be formed to be groove-shaped, v-shaped and additionally or alternatively swallow-tailed. The support element may be integrally formed. Such an embodiment offers the advantage that a mechanical system or guiding mechanism comprising a double wing unit and elastic means coupled to the double wing unit may be provided. Thus, equilateral, synchronous and free-of-play or reduced-play guidance or parallel guidance of a top part of the key module may be effected. Also, a force-path characteristic of the key module with respect to actuation may be adjusted by the manufacturer, the customer and additionally or alternatively the user. For example, the key module may allow for customized further processing by the user.

The key module may also comprise at least one spring element for providing a reset force upon actuation of the key module. In particular, the at least one spring element may be formed as a tension spring or as a compression spring. The at least one spring element may also be referred to as elastic means. Such an embodiment offers the advantage that a defined force-path characteristic of actuation of the key module and a reset force can be provided in a constructively simple and reliable manner adjustable by exchanging the at least one spring element. In addition, a compression spring may optionally also serve as a bending guide.

Also, a keyboard is presented, wherein the keyboard comprises:

at least one item of an embodiment of the key module as previously mentioned; and a circuit substrate, wherein the at least one key module is arranged on the circuit substrate.

At least one key module as previously mentioned may thus be employed or used in connection with the keyboard. The at least one key module is directly attachable to the circuit substrate, for example by means of soldering or inserting connector pins.

The present invention will be explained in greater detail on the basis of the attached drawings, wherein.

In the subsequent description of preferred embodiments of the present invention, the same or similar reference numerals shall be used for similarly acting elements depicted in the various figures, wherein repeated description of these elements shall be omitted.

Figure 1:
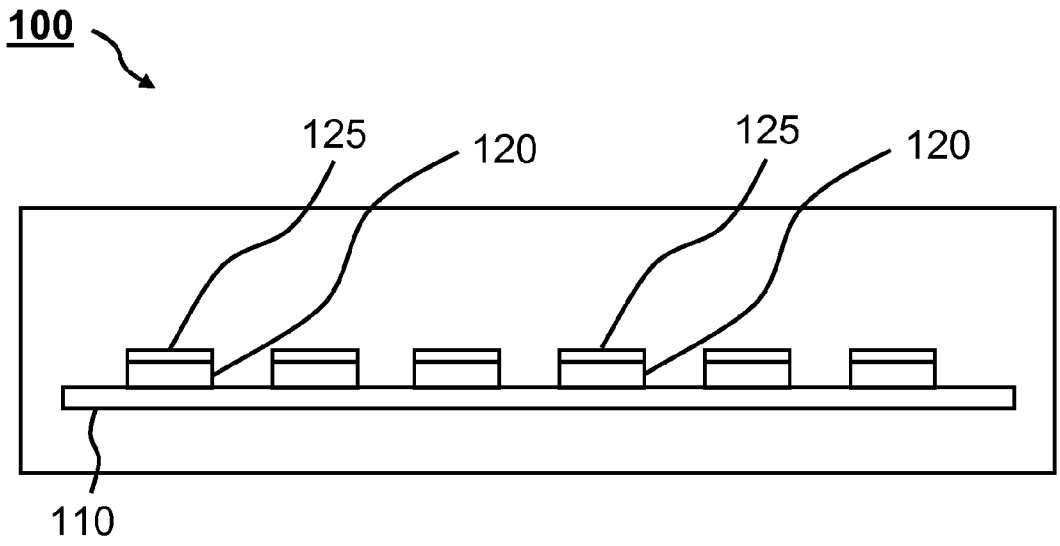
FIG. 1 shows a schematic illustration of a keyboard with key modules according to an embodiment of the present invention.

FIG. 1 shows a schematic illustration of a keyboard 100 with key modules 120 according to an embodiment. For example, the keyboard 100 is part of a notebook computer, a laptop computer or the like. Alternatively, the keyboard 100 is a peripheral device for a computer, in particular.

The keyboard 100 comprises a circuit substrate 110. The circuit substrate 110 is a conductor board, circuit board or the like, for example. According to the embodiment illustrated in FIG. 1, the keyboard 100 comprises a plurality of key modules 120. The key modules 120 are arranged on the circuit substrate 110. Here, the key modules 120 are soldered onto the circuit substrate 110, for example.

Furthermore, according to the embodiment shown and described in FIG. 1, a keycap 125 is attached to each key module 120. Each keycap 125 is coupled to a respective key module 120. Each unit of key module 120 and keycap 125 represents a key of the keyboard 100. Alternatively, each key module 120 represents a key of the keyboard 100. Particularly the key modules 120 shall be explained in greater detail with reference to subsequent figures.

The keycap 125 represents a part of a key which is visible and touchable for a user of the keyboard 100. Actuation of a key module 120 is effected by pressing onto the keycap 125. Each key module 120 is configured to react to an actuation force with a force-path characteristic of resistance or a reset force. Furthermore, each key module 120 is configured to establish an electrical connection in response to actuation with a predefined actuation path, thereby performing a switching operation.

Figure 2:
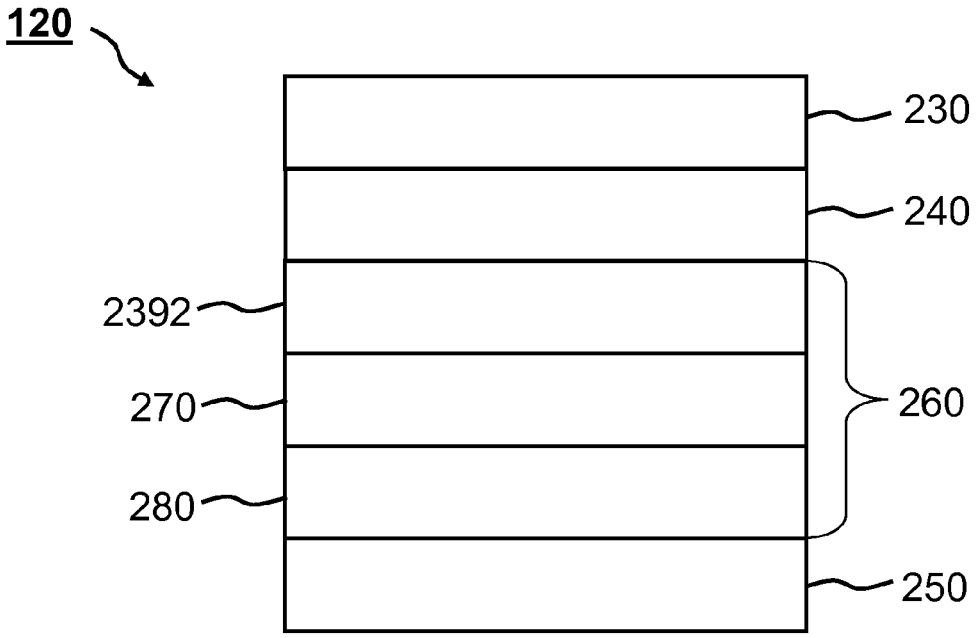
FIG. 2 shows a schematic illustration of a key module according to an embodiment of the present invention.

FIG. 2 shows a schematic illustration of a key module 120 according to an embodiment of the present invention. According to the embodiment of the present invention illustrated here, the key module 120 comprises a guide to hundred 30, a spring element 240, a support element 250 and a switch unit 260 with a housing 270, a contact device 280 and an auxiliary actuator 2392. The arrangement of the guide 230, the spring element 240, the support element 250, the housing 270, the contact device 280 and the auxiliary actuator 2392 is to be understood as merely exemplary and schematic in the illustration of FIG. 2 and may also vary from embodiment to embodiment.

The guide 230 is formed to guide a movement of the key module 122 during actuation. The guide 230 comprises double wing mechanics, scissor-type mechanics or the like, for example. The at least one spring element 240 is configured to provide a reset force upon actuation of the key module 120. The support element 250 is configured to support at least the guide.

According to the embodiment of the present invention illustrated in FIG. 2, the switch unit 260 comprises the housing 270, the contact device 280 and the auxiliary actuator 2392. The housing 270 is configured to at least partially accommodate the contact device 280. The contact device 280 is configured to establish electrical contact, in order to enable a switching signal or actuation signal, and/or to produce an actuation sound in the course of the actuation of the key module 120. The contact device 280 comprises a fixed contact piece with a first contact and a contactor with a first spring clip carrying a second contact and/or a second spring clip for producing an actuation sound and/or at least one actuation portion. The contactor is integrally formed. The auxiliary actuator 2392 is configured to actuate the contact device 280.

The housing 270, the contact device 280 and the auxiliary actuator 2392 shall be explained in greater detail with reference to subsequent figures.

Figure 3:
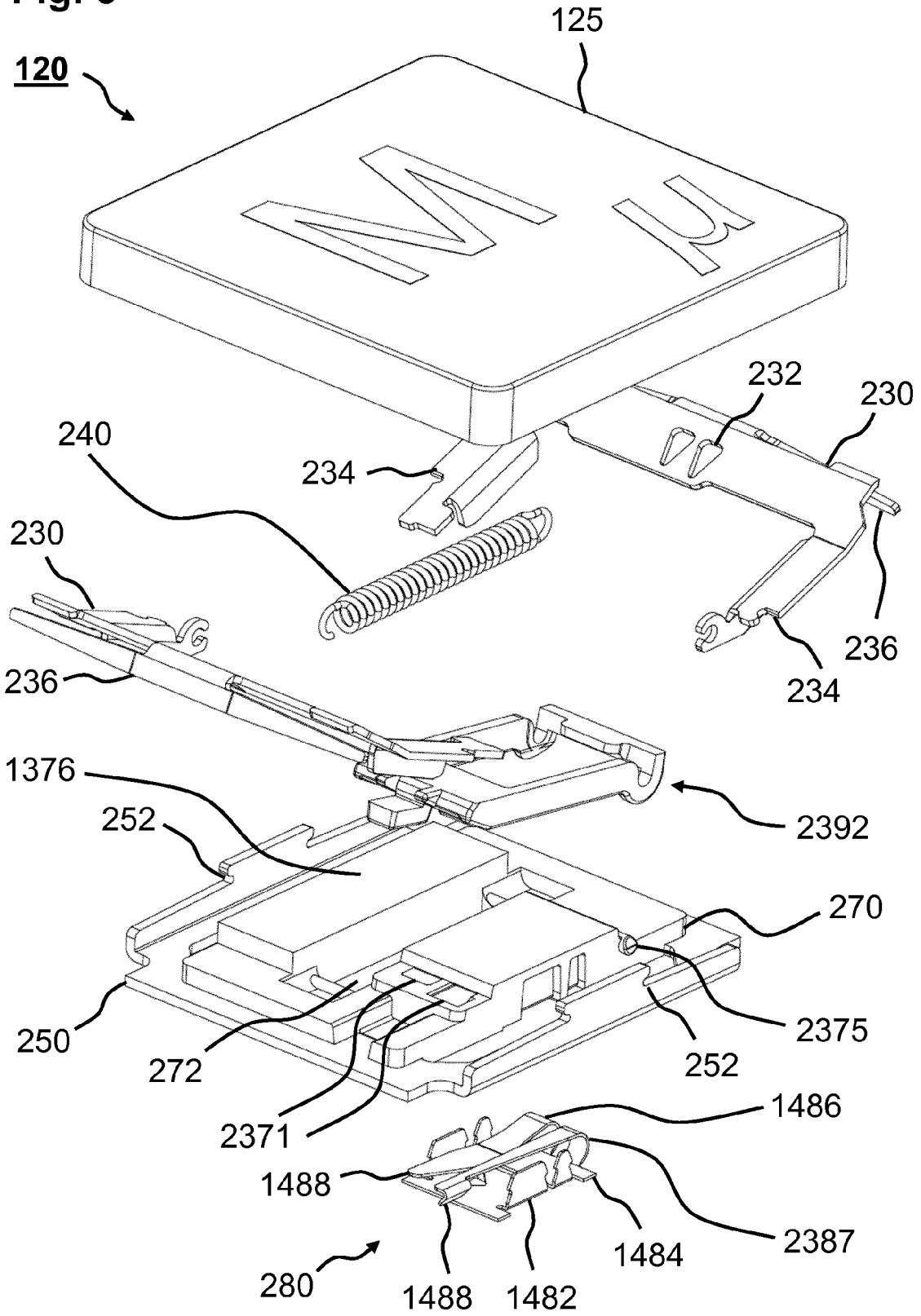
FIG. 3 shows a partially exploded view of a key module according to an embodiment of the present invention.

FIG. 3 shows a partially exploded view of a key module 120 according to an embodiment of the present invention. The key module 120 according to the embodiment of the present invention shown in FIG. 3 corresponds to or is similar to the key module from one of the previously described figures.

In FIG. 3, in particular the keycap 125, the guide 230 in form of two wing elements 230 with mounting portions 232, bearing portions 234 and connecting portions 236, the spring element 240, the support element 250 with accommodating portions 252, the housing 270 with a groove 272, a subsection 1376, two actuation openings 2371 and a holding portion 2375, the contact device 280 with the fixed contact piece 1482, the contactor 1484, the first spring clip 1486, two actuation portions 1488 and the second spring clip 2387, and the auxiliary actuator 2392 are shown of the key module 120.

According to the embodiment illustrated in FIG. 3, the key module 120 also comprises the keycap 125. Alternatively, the keycap 125 is provided separately from the key module 120 and is coupleable thereto. In a state in which the keycap 120 is mounted to the key module 120, the key module 120 and the keycap 125 represent a key. The keycap 125 represents a top part of the key module 120 or for the key module 120. At least one alphanumeric character or special character is printed on the keycap 125.

According to the embodiment of the present invention illustrated in FIG. 3, the key module 120 comprises, as the guide 230, a first wing element 230 and a second wing element 230 for guiding a movement of the key module 120 upon actuation by a user. The two wing elements 230 are coupled to each other mechanically. In the illustration of FIG. 3, the wing elements 230 are shown in a non-actuated state of the key module 120. In the non-actuated state, the wing elements 230 coupled to each other mechanically have an obtuse resting angle between each other. In an actuated state of the key module 120, the wing elements 230 coupled to each other have an opening angle greater than the resting angle between each other. The opening angle may also be 180 degrees. A difference between the resting angle and the opening angle may, for example, lie a range from about 12 degrees to 18 degrees.

Each wing element 230 comprises a bar, a first arm and a second arm. The arms extend away from the bar. In particular, the arms extend away from the bar at right angles. Also, the arms extend in parallel with respect to each other within a tolerance range, for example. Alternatively, the arms may also extend obliquely with respect to each other. According to the embodiment illustrated in FIG. 3, the first wing element 230 and the second wing element 230 are formed to be identical with each other. In addition, each wing element 230 is integrally formed here. For example, each wing element 230 is also formed of a metal material. With reference to subsequent figures, it will be explained in greater detail how the wing elements 230 are formed and coupled to each other.

According to the embodiment shown and described in FIG. 3, each of the wing elements 230 comprises two mounting portions 232 for mounting a spring element and two bearing portions 234 for bearing the wing element 230, for example. The mounting portions 232 are formed on the bar of the wing element 230. The mounting portions 232 are formed as through-holes, particularly as rounded triangular through-holes, in the wing element 230. The bearing portions 234 are formed on the arms of the wing element 230. A first bearing portion 234 is formed on the first arm, and a second bearing portion 234 is formed on the second arm. The bearing portions 234 are formed as ledges, steps or noses in outside edges of the arms of the wing element 230.

Each wing element 230 also comprises at least one connecting portion 236 for connecting the wing element 230 to a top part for the key module 120. Here, the top part comprises the keycap 125. According to the embodiment illustrated in FIG. 3, each wing element 230 comprises one connecting portion 236, for example. The connecting portion 236 is formed on the bar of the wing element 230. Here, the connecting portion 236 comprises elastically deformable beam portions. The keycap is connectable to the wing elements 230, and thus to the key module 120, via a snap-fit by means of the connecting portions 236.

The key module 120 further comprises at least one spring element 240 for providing a reset force upon the actuation of the key module 120. According to the embodiment illustrated in FIG. 3, the key module 120 comprises one spring element 240, for example. The spring element 240 is mounted to one of the mounting portions 232 of the first wing element 230 and to one of the mounting portions 232 of the second wing element 230. Here, the spring element 240 is a tension spring.

The key module 120 also comprises a support element 250 for supporting the wing elements 230. The support element 250 is also formed to support the spring element 240 and, if applicable, the keycap 125 when they are attached to the wing elements 230. For example, the support element 250 is formed of a metal material. The support element 250 comprises a plurality of accommodating portions 252 for accommodating the bearing portions 234 of the wing elements 230. According to the embodiment shown and described in FIG. 3, the support element 250 here comprises four accommodating portions 252. The accommodating portions 252 are formed as bearing grooves in the support element 250. In other words, the accommodating portions 252 are formed to be groove-shaped, v-shaped or swallow-tailed. The bearing portions 234 of the wing elements 230 are supported in the accommodating portions 252 in a mounted state of the key module 120. Thus, the wing elements 230 are supported on the support element 250 so as to be pivotable or tiltable in a pre-definable angle range. The angle range is also definable by a shape of the accommodating portions 252.

The group of components comprising the wing elements 230 and the spring element 240 may also be referred to as a guiding mechanism. Thus, the support element 250 is formed to support at least the guiding mechanism.

Moreover, the key module 120 comprises the switch unit 260. The switch unit 260 comprises the housing 270, the contact device 280 and the auxiliary actuator 2392. The contact device 280 is at least partially arrangeable in the housing 270. In other words, the housing 270 is formed to accommodate at least a subsection of the contact device 280. The housing 270 is formed of plastics material, for example. The auxiliary actuator 2392 is formed to actuate the contact device 280. The auxiliary actuator 2392 is formed of plastics material, for example.

According to the embodiment shown in FIG. 3, for example only one groove 272 for accommodating at least a subsection of the spring element 240 in an actuated state of the key module 120 is formed in the housing 270. Here, the groove 272 is arranged between the subsection 1376 and a further subsection of the housing 270 in which the contact device 280 may be partially accommodated. The subsection 1376 of the housing 270 is formed to scatter and/or focus light from a light source. The light source also may be accommodated at least partly within the housing 270, according to an embodiment.

According to the embodiment of the present invention illustrated in FIG. 3, for example two actuation openings 2371 for exposing the at least one actuation portion 1488 of the contact device 280 are formed in the housing 270. Furthermore, the housing 270 comprises at least one holding portion 2375 for holding the auxiliary actuator 2392. According to the embodiment of the present invention illustrated here, the at least one holding portion 2375 is formed as a pin. The housing 270 is arranged on the support element 250.

The contact device 280 is configured to establish electric contact and to produce an actuation sound in the course of actuation of the key module 120. The contact device 280 can be pressed or deformed by the auxiliary actuator 2392, for example, in order to effect the establishment of the electric contact and the production of the actuation sound. According to another embodiment, the contact device 280 can be pressed or deformed by the keycap 125, for example, in order to effect the establishment of the electric contact and the production of the actuation sound.

According to the embodiment of the present invention illustrated in FIG. 3, the contactor 1484 of the contact device 280 comprises the second spring clip 2387 for producing an actuation sound in addition to the first spring clip 1486 carrying the second contact. The first spring clip 1486 comprises an actuation portion 1488. Furthermore, the second spring clip 2387 also comprises an actuation portion 1488. The contactor 1484 is integrally formed. In particular, the contactor 1484 is formed as a stamped part or as a stamped and bent part of a metal material.

The housing 270, the contact device 280 and the auxiliary actuator 2392 shall be explained in greater detail with reference to subsequent figures.

Figure 4:
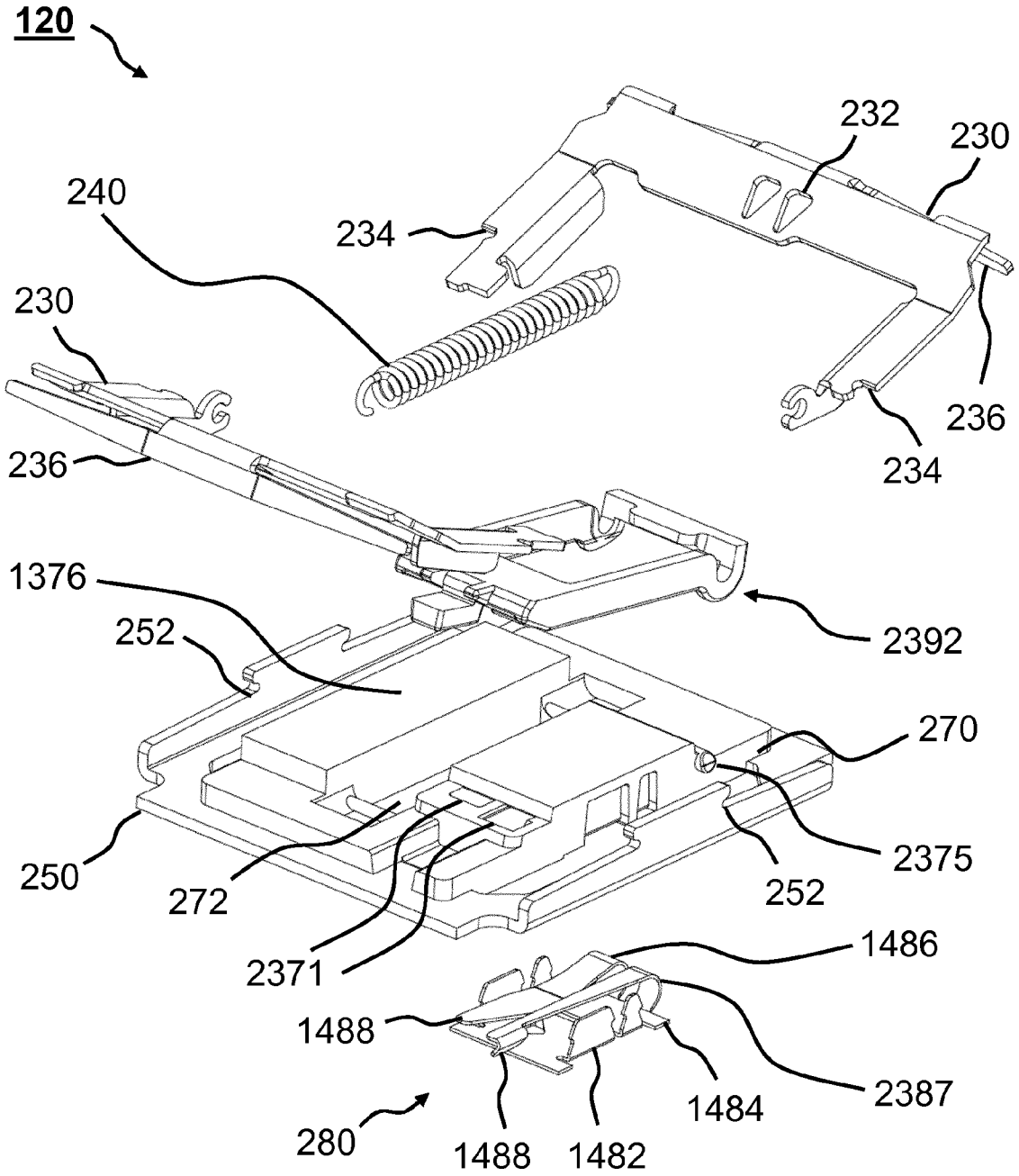
FIG. 4 shows a partially exploded view of parts of the key module from FIG. 3.

FIG. 4 shows a partially exploded view of parts of the key module 120 from FIG. 3. The illustration in FIG. 4 corresponds to the illustration of FIG. 3, except that the keycap is omitted in the illustration.

Figure 5:
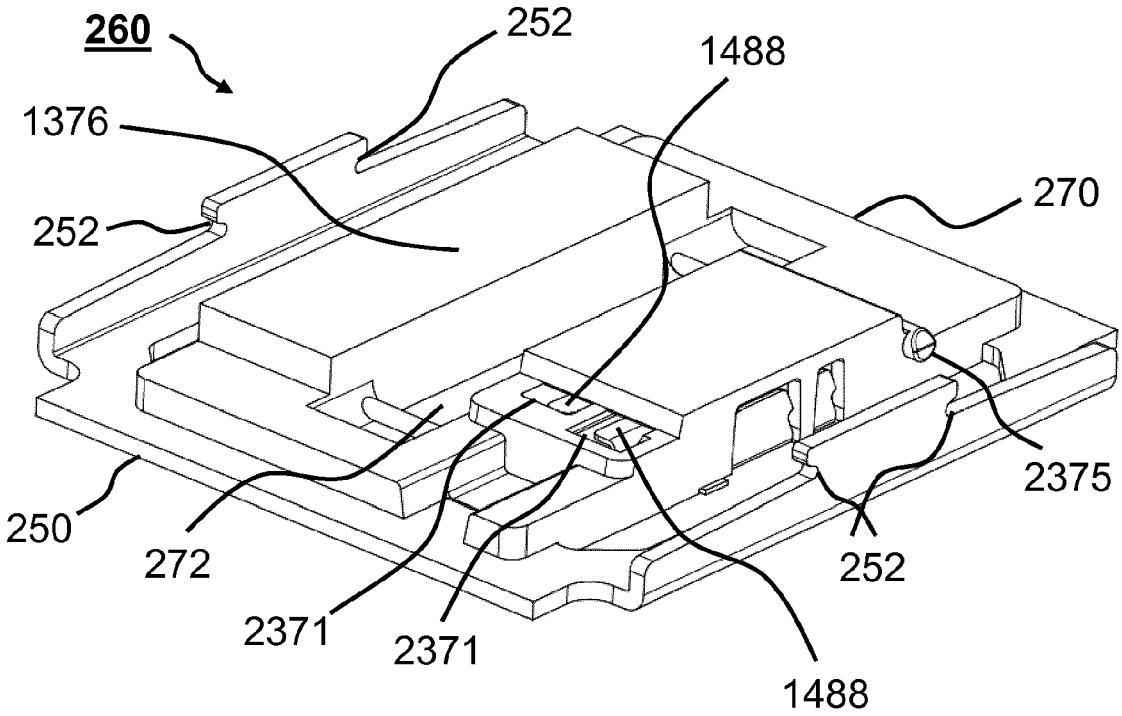
FIG. 5 shows a slant top view onto the switch unit and the support element from FIG. 3 or FIG. 4 in a partially assembled state.

FIG. 5 shows a slant top view onto the switch unit 260 and the support element 250 from FIG. 3 or FIG. 4 in a partly assembled state. The contact device is partially accommodated in the housing 270. The actuation portions 1488 of the contact device are visible through the actuation openings 2371 of the housing 270. The auxiliary actuator 2392 is omitted in the illustration of FIG. 5.

Figure 6:
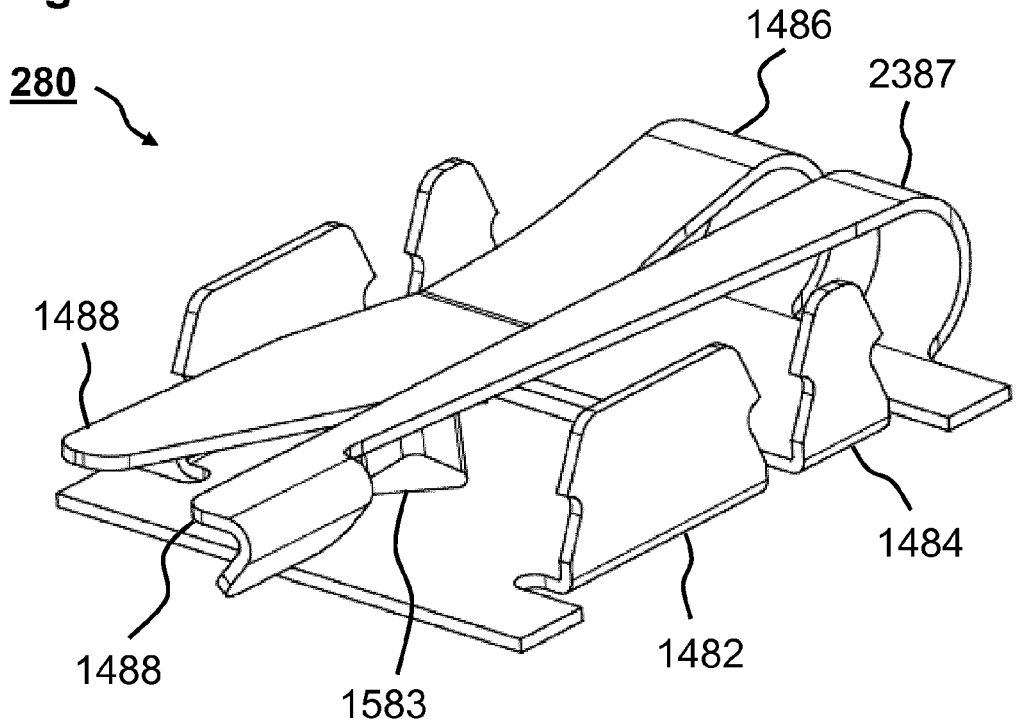
FIG. 6 shows the contact device from FIG. 3, FIG. 4 or FIG. 5.

FIG. 6 shows the contact device 280 from FIG. 3, FIG. 4 or FIG. 5. The contact device 280 is usable as a contact device for a switch unit of a key module of one of the previously described figures or of another key module.

The contact device 280 comprises the fixed contact piece 1482 and the contactor 1484. The fixed contact piece 1482 and the contactor 1484 are electrically isolated from each other. A first contact 1583 of the contact device 280 is arranged on the fixed contact piece 1482. A second contact of the contact device 280 is arranged on the contactor 1484.

The contactor 1484 comprises the first spring clip 1486 carrying the second contact, the second spring clip 2387 and the two actuation portions 1488. The first spring clip 1486 and the second spring clip 2387 are movable via the actuation portions 1488 until electric contact is established between the first contact 1583 and the second contact. The actuation portions 1488 may be actuated by the auxiliary actuator upon actuation of the key module. The contactor 1484 is elastically deformable. Thus, the contactor 1484 also functions as an elastic means.

The first contact 1583 comprises a linear or elongated contact region with a first axis of extension. Even though only implicitly shown in the illustration of FIG. 6, the second contact 1585 also comprises a linear or elongated contact region with a second axis of extension. The first axis of extension and the second axis of extension cross each other, wherein electric and mechanical contact can be established between the first contact 1583 and the second contact in a punctiform contact portion. According to the embodiment illustrated here, each axis of extension extends obliquely, in particular at an angle of 45 degrees, for example, with respect to a longitudinal axis or transversal axis of the fixed contact piece 1482 or the contactor 1484. According to the embodiment illustrated in FIG. 6, the first contact 1583 and the second contact each have a triangular sectional profile. For example, the first contact 1583 and the second contact are cut from a wire and welded on the contact device 280. The contactor 1484 is formed to establish the electric contact while producing friction between the first contact 1583 and the second contact.

The first spring clip 1486 and the second spring clip 2187 extend alongside each other and across the fixed contact piece 1482. What can also be seen more clearly in the illustration of FIG. 6 is that the first spring clip 1486 is tapered in the actuation portion 1488. On a side facing away from the first spring clip 1486, the actuation portion 1488 of the second spring clip 2387 comprises a kink, at which the actuation portion 1488 is bent toward the fixed contact piece 1482 and the first spring clip 1486.

Figure 7:
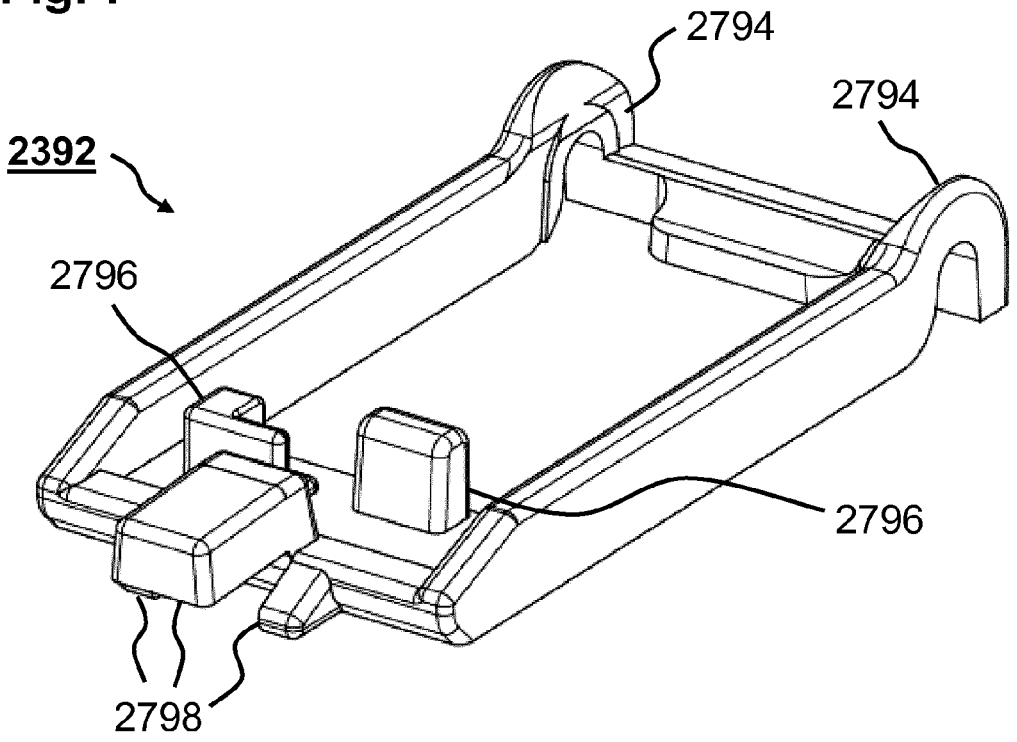
FIG. 7 shows the auxiliary actuator from FIG. 3 or FIG. 4 in a slant bottom view.

FIG. 7 shows the auxiliary actuator 2392 from FIG. 3 or FIG. 4 in a slant bottom view. According to the embodiment of the present invention illustrated here, the auxiliary actuator 2392 comprises two attaching portions 2794, two noses 2796 and three fixing portions 2798. The auxiliary actuator 2392 is integrally formed, for example of plastics material.

The attaching portions 2794 are formed to allow for movably attaching the auxiliary actuator 2392 to the at least one holding portion of the housing of the switch unit. For example, the attaching portions 2794 are formed to be arcuate or hook-shaped and are formed to accommodate the at least one holding portion by latching or snapping.

The noses 2796 are formed to deflect the first spring clip and/or the second spring clip of the contact device upon the actuation of the key module. According to another embodiment, wherein the contact device is formed differently, the auxiliary actuator 2392 may comprise only one nose 2796 and/or at least one differently formed nose 2796.

The fixing portions 2798 are formed to fix the auxiliary actuator 2392 to the first wing element or to the second wing element. The fixing portions 2798 are formed as protrusions. According to another embodiment, the auxiliary actuator 2392 may comprise a different number of fixing portions 2798 and/or differently formed fixing portions 2798.

Figure 8:
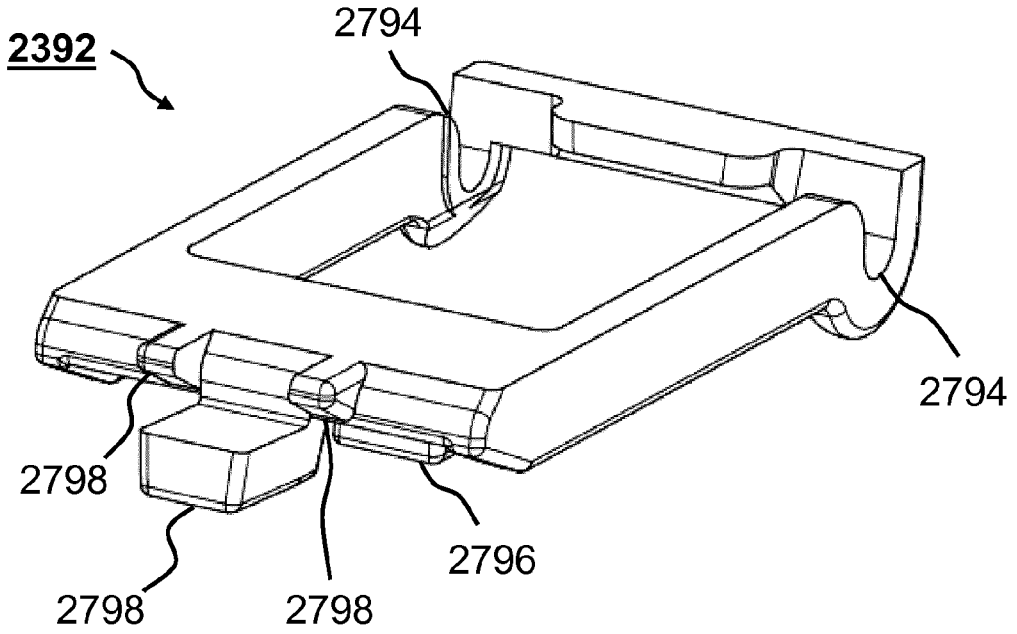
FIG. 8 shows the auxiliary actuator from FIG. 3, FIG. 4 or FIG. 7 in a slant top view.

FIG. 8 shows the auxiliary actuator 2392 from FIG. 3, FIG. 4 or FIG. 7 in a slant top view. Due to the illustration, one of the noses 2796 is obscured by one of the fixing portions 2798. It can be seen that the fixing portions 2798 are disposed and formed to arrange the bar of one of the wing elements between one of the fixing portions 2798 and the remaining two fixing portions 2798.

Figure 9:
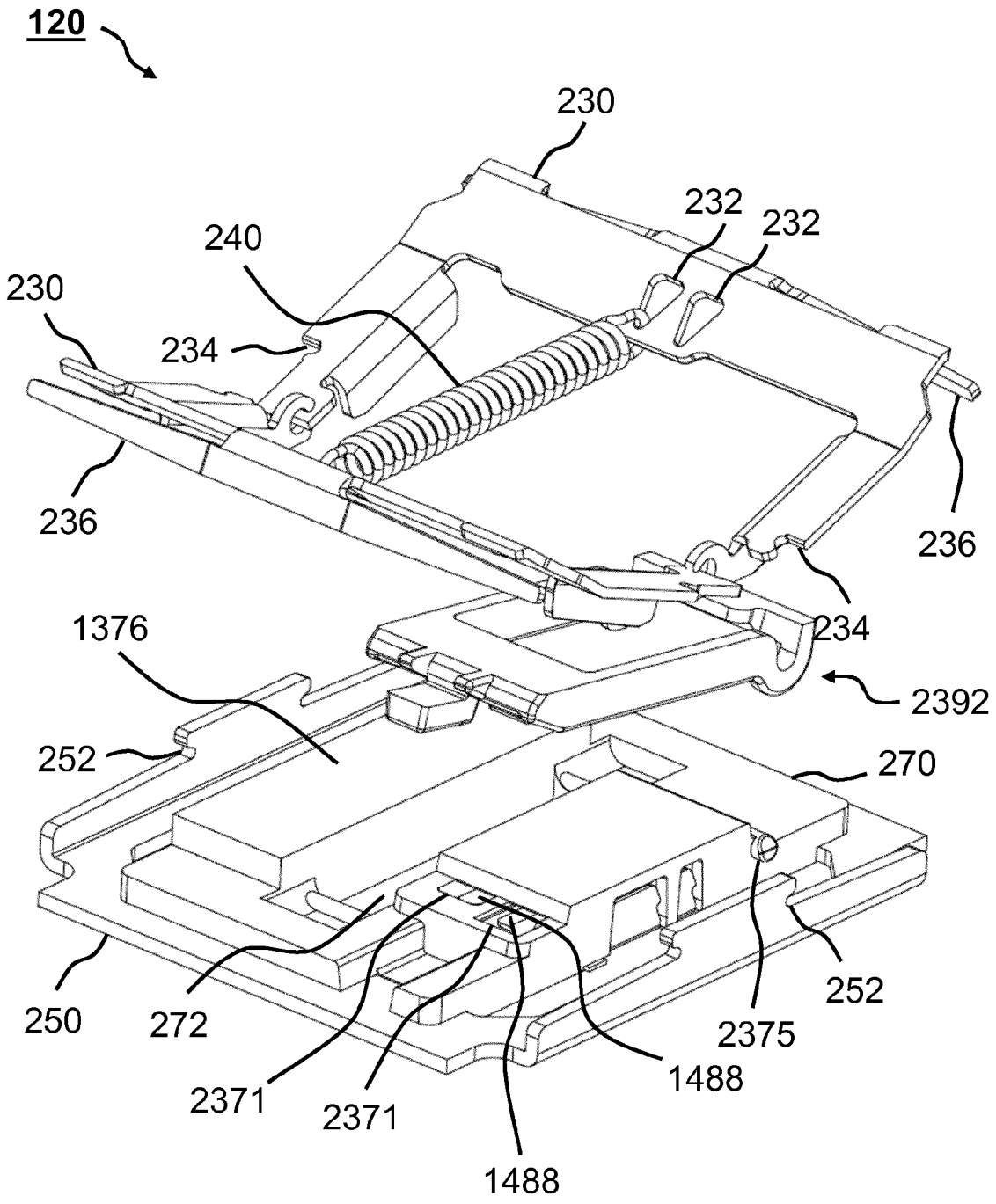
FIG. 9 shows a partially exploded view of parts of the key module from FIG. 4 in a partially assembled state.

FIG. 9 shows a partially exploded view of parts of the key module 120 from FIG. 4 in a partially assembled state. The spring element 240 is hooked into one mounting portion 232 each of the first wing element 230 and of the second wing element 230. Furthermore, the wing elements 230 are coupled to each other via their coupling portions. The switch unit and the support element 250 are shown in the state of FIG. 5. Thus, the contact device is at least partially accommodated in the housing 270.

Figure 10:
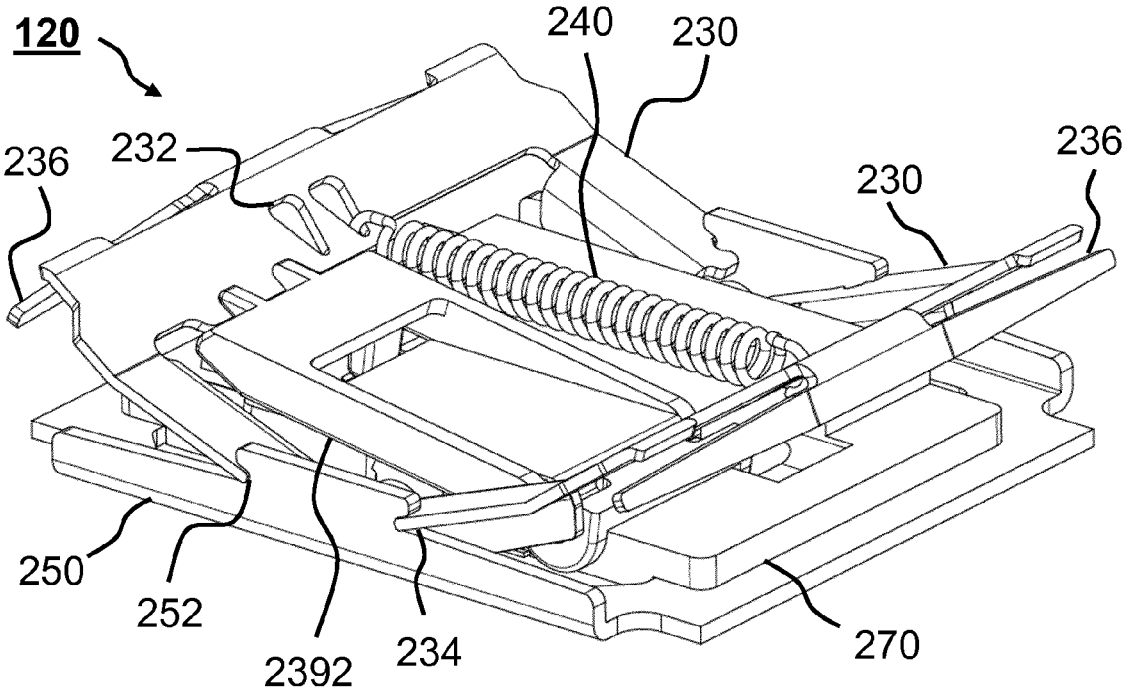
FIG. 10 shows a slant top view onto the key module from FIG. 4 or FIG. 9 in a mounted and non-actuated state.

FIG. 10 shows a slant top view onto the key module 120 from FIG. 4 or FIG. 9 in a mounted and non-actuated state. The wing elements 230 are attached to the support element 250, wherein the bearing portions 234 of the wing elements 230 are arranged in the accommodating portions 252 of the support element 250. The auxiliary actuator 2392 is attached to the housing 270 by means of its attaching portions and is fixed to one of the wing elements 230 by means of its fixing portions. A plane of extension of the auxiliary actuator 2392 is inclined relative to a plane of extension of the housing 270.

Figure 11:
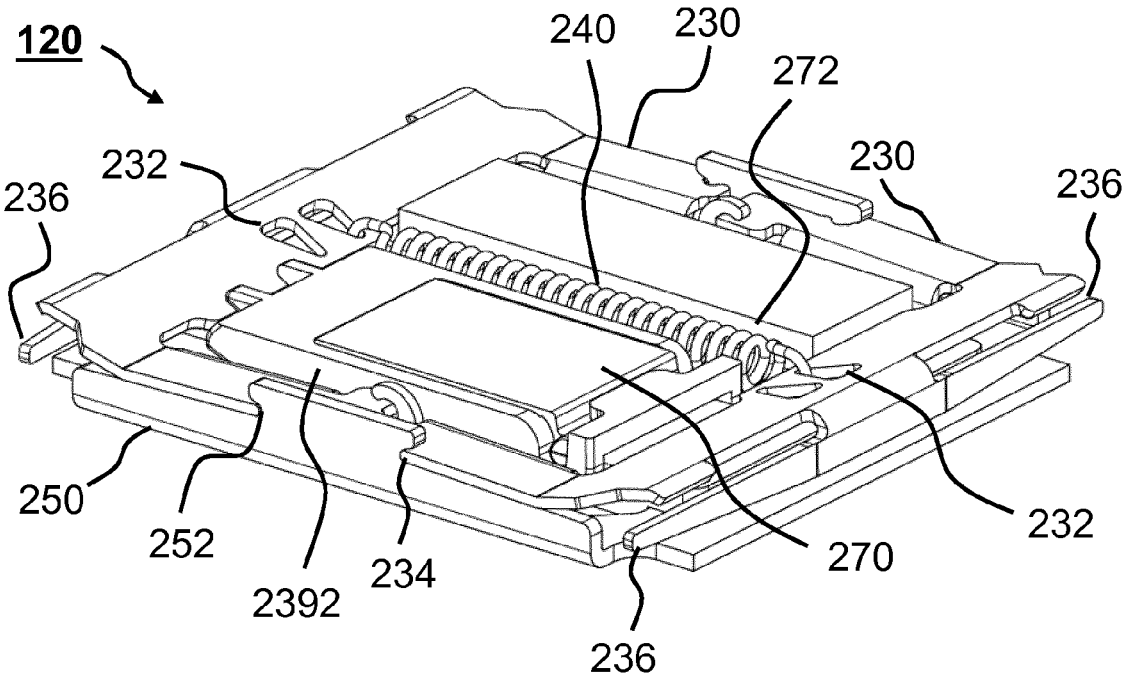
FIG. 11 shows a slant top view onto a key module from FIG. 4, FIG. 9 or FIG. 10 in a mounted and actuated state.

FIG. 11 shows a slant top view onto the key module 120 from FIG. 4, FIG. 9 or FIG. 10 in a mounted and actuated state. It can be seen that the spring element 240 is plunged into the groove 272 of the housing 270. Part of an actuation force exerted on the wing elements 230 is transferred to the contact device of the switch unit via the auxiliary actuator 2392. The plane of extension of the auxiliary actuator 2392 is oriented along the plane of extension of the housing 270 in the actuated state of the key module 120.

Figure 12:
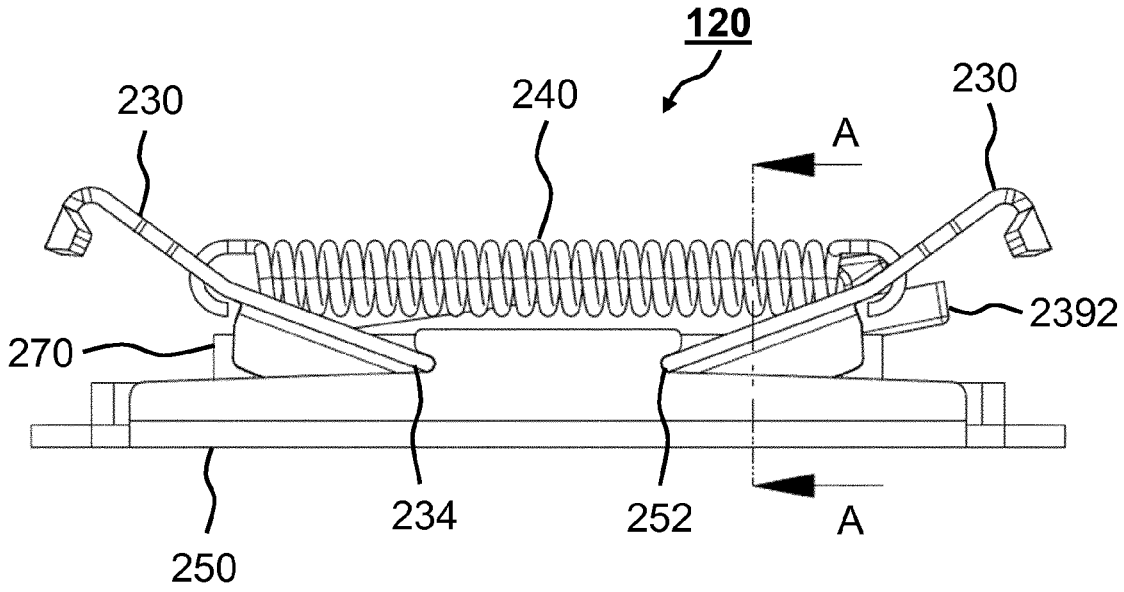
FIG. 12 shows a side view of the key module from FIG. 10.

FIG. 12 shows a side view of the key module 120 from FIG. 10. In the side view of FIG. 12, the wing elements 230 with two of the bearing portions 234, the spring element 240, the support element 250 with two of the accommodating portions 252, a subsection of the housing 270 as well as a subsection of the auxiliary actuator 2392 are shown of the key module 120. What is also depicted is a cutting line A-A for a sectional view or partially sectional view through the key module 120. The cutting line A-A extends transversally to a longitudinal axis of the spring element 240.

Figure 13:
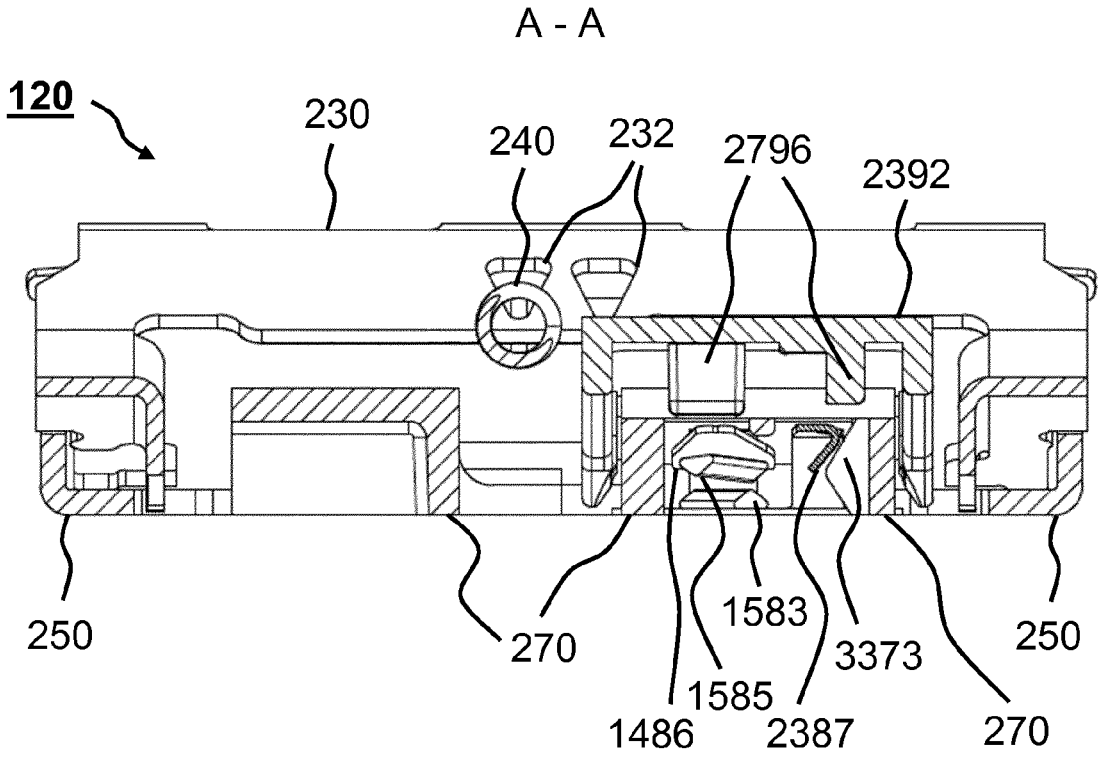
FIG. 13 shows a partially sectional view of the key module from FIG. 12.

FIG. 13 shows a partially sectional view of the key module 120 from FIG. 12 along the cutting line A-A. In the partially sectional view of FIG. 13, subsections of one of the wing elements 230 with two of the mounting portions 232, subsections of the spring element 240, subsections of the supporting element 250, subsections of the housing 270 with a deflecting portion 3373, subsections of the auxiliary actuator 2392 with the two noses 2796 and subsections of the contact device with the first spring clip 1486, the second spring clip 2387, the first contact 1583 and the second 1585 are shown of the key module 120.

It can be seen that a first one of the noses 2796 of the auxiliary actuator 2392 is formed and arranged to actuate or deflect the first spring clip 1486, and thus to close the contacts 1583 and 1585. Furthermore, it can be seen that a second one of the noses 2796 of the auxiliary actuator 2392 is formed and arranged to actuate or deflect the second spring clip 2387 in order to produce an actuation sound. The deflecting portion 3373 of the housing 270 is formed to deflect the second spring clip 2387 of the contact device 280 when the key module 120 is being actuated. The deflecting portion 3373 is obliquely inclined with respect to a movement or axis of movement of the key module 120 during actuation thereof. A kink angle of the actuation portion of the second spring clip 2387 is greater than an angle of inclination of the deflecting portion 3373 relative to the axis of movement. Thus, a terminal edge of the second spring clip 2387 is spaced from the deflecting portion 3373. In this way, friction, scratching and the like between the deflecting portion 3373 and the actuation portion of the second spring clip 2387 can be minimized or prevented.

During actuation of the key module 120, there is movement of the wing elements 230, which is transferred to the first spring clip 1486 and to the second spring clip 2387 via the auxiliary actuator 2392. In the course of such an excursion movement of the first spring clip 1486, the first contact 1583 and the second contact 1585 come into contact with each other. Furthermore, in the course of such an excursion movement of the second spring clip 2387, it is deflected laterally at its actuation portion by the deflecting portion 3373. Due to the slope or inclination of the deflecting portion 3373 relative to the movement, the lateral deflection of the second spring clip 2387 increases with increasing excursion, until the actuation portion of the second spring clip 2387 slips from the nose 2796 of the auxiliary actuator 2392 actuating the same, and there is a rebound of the second spring clip 2387 against the housing 270 or the auxiliary actuator 2392, which produces the actuation sound.

FIG. 5 shows a slant bottom view of the key module 120 from FIG. 4. The key module 120 corresponds to the key module from FIG. 10 except that the keycap 125 is connected to the wing elements 130 and the connecting portions 236 are formed differently and comprise bent end portions 238.

The keycap 125, the wing elements 230 with two of the four mounting portions 232, two of the four bearing portions 234 and one of the two connecting portions 236 with the bent end portion 238 are shown of the key module 120 here. Furthermore, the support element 250 with two of the accommodating portions 252 and soldering surfaces 554, the housing 270 with a receiving bay 574 and the contact device 280 with soldering surfaces 582 are shown.

The soldering surfaces 554 of the support element 250 serve for attaching the support element 250 to a circuit substrate of a keyboard. The soldering surfaces 582 of the contact device 280 of the switch unit serve for attaching the switch unit to the circuit substrate of the keyboard. Hence, the key module 120 can be fitted directly on the circuit substrate by soldering the soldering surfaces 554 and 582 onto the circuit substrate.

According to an embodiment of the present invention illustrated here, the receiving bay 574 for receiving a light source is formed in the housing 270 of the switch unit. The light source may be a light-emitting diode for surface mounting or SMD LED (SMD=surface-mounted device; LED=light-emitting diode), for example. Furthermore, according to an embodiment, the housing 270 is formed of a transparent or opaque material, in particular a plastics material, at least in a subsection.

Figure 14:
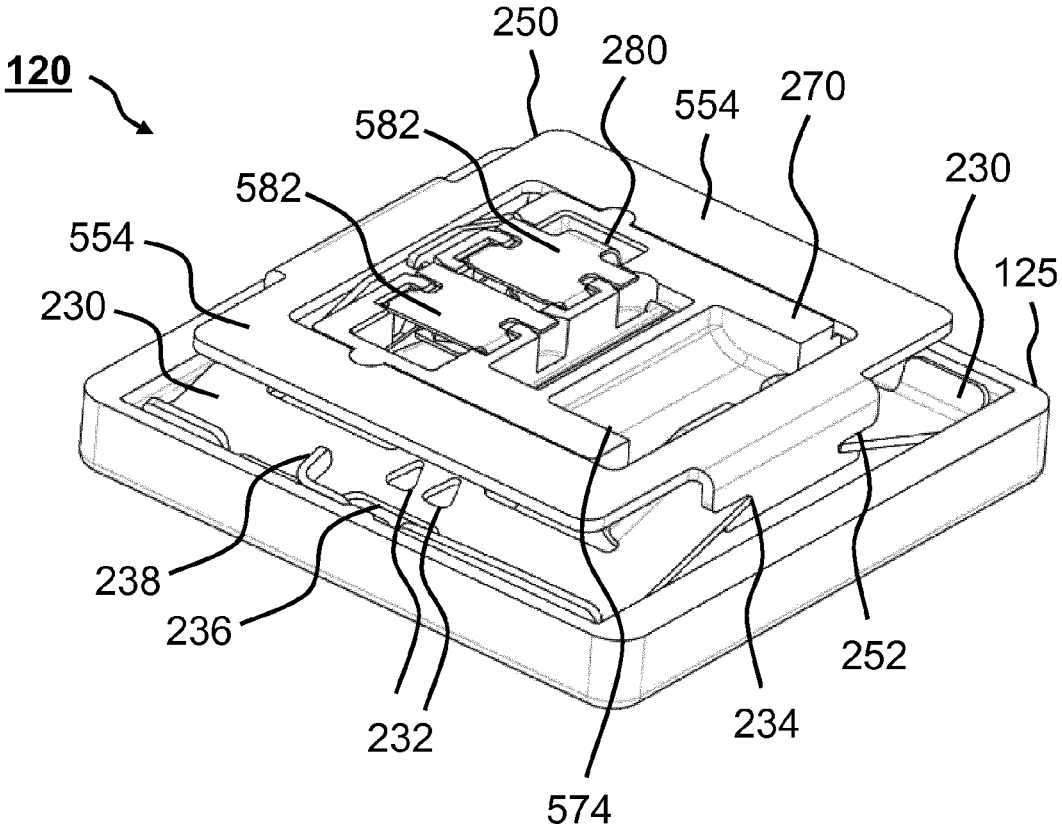
FIG. 14 shows a slant bottom view of a key module according to an embodiment of the present invention.

It can be seen in the illustration of FIG. 14 that the switch unit with the housing 270 and the contact device 280 is arranged in a constructed space surrounded by the bars and arms of the wing elements 230.

According to another embodiment, in particular as an alternative to the soldering surfaces 554 and 582, the support element and the switch unit may be attachable to the circuit substrate of the keyboard by means of connector pins.

Figure 15:
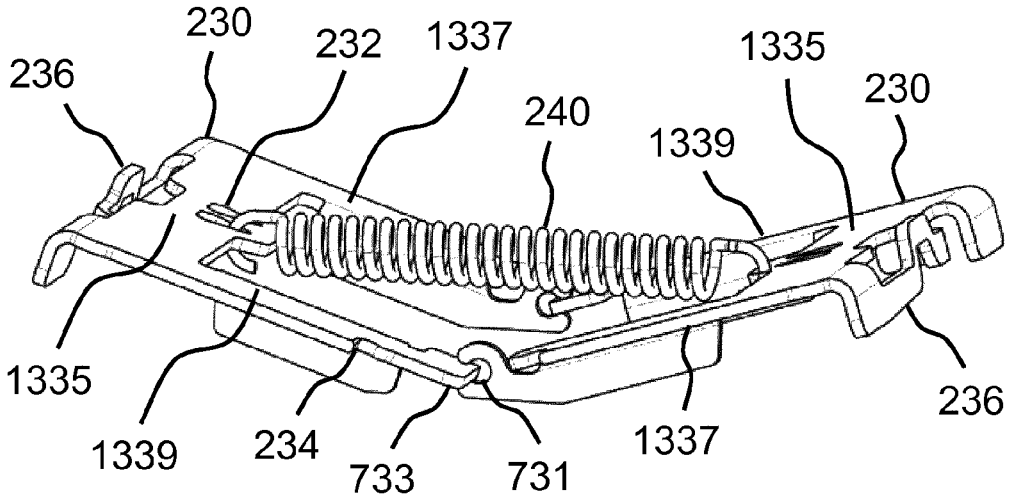
FIG. 15 shows a slant view of a subsection of the key module from FIG. 14.

FIG. 15 shows a slant view of a subsection of the key module from FIG. 14. The subsection of the key module illustrated in FIG. 15 includes the guiding mechanism, i.e. the wing elements 230 and the spring element 240. In the illustration of FIG. 15, the mounting portions 232, the bearing portions 234, the connecting portions 236, first coupling portions 731 and second coupling portions 733 and bars 1335, first arms 1337 and second arms 1339 are shown of the wing elements 230 here.

The coupling portions 731, 733 are formed to couple the wing elements 230 to each other mechanically. Each wing element 230 comprises a first coupling portion 731 and a second coupling portion 733. The first coupling portion 731 is formed at an end of the first arm of each wing element 230, and the second coupling portion 733 is formed at an end of the second arm of each wing element 230. The first coupling portion 731 and the second coupling portion 733 of each wing element 230 are formed differently. All first coupling portions 731 are formed identically, and all second coupling portions 733 are formed identically. Thus, the first coupling portion 731 of the first wing element 230 is coupleable to the second coupling portion 733 of the second wing element 230, and the second coupling portion 733 of the first wing element 230 is coupleable to the first coupling portion 731 of the second wing element 230. According to the embodiment illustrated here, the first coupling portion 731 is formed as a link, and the second coupling portion 733 is formed as a protrusion or a plate. According to another embodiment, the first coupling portion and the second coupling portion may be formed as teeth.

Figure 16:
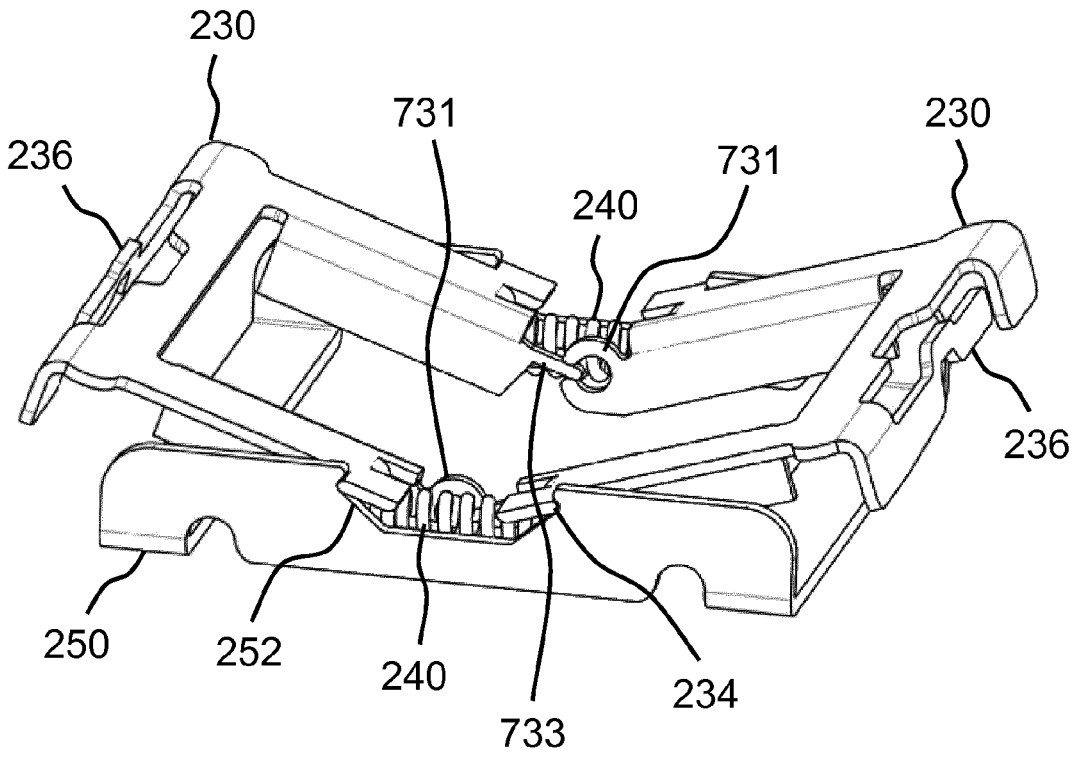
FIG. 16 shows a slant view of a subsection of a key module according to an embodiment of the present invention.

FIG. 16 shows a slant view of a subsection of a key module according to an embodiment. The subsection illustrated in FIG. 16 corresponds to the subsection shown in FIG. 12, except that two spring elements 240, which are formed as compression springs, are provided, and a support element 250 similar to the support element from one of the previously described figures is shown in the illustration, wherein the wing elements 230 and the support element 250 are partly adapted to the spring elements 240 in terms of construction.

Each of the spring elements 240 extends along a pair of coupled arms of the wing elements 230. The mounting portions of the wing elements 230 are obscured by wall portions of the support element 250 comprising the accommodating portions 252 in the illustration of FIG. 16. The wing elements 230 are coupled to each other via the coupling portions 731 and 733 and comprise the bearing portions 234 and the connecting portions 236.

If an embodiment comprises an "and/or" connection between a first feature and a second feature, this may be read so as to mean that the embodiment comprises both the first feature and the second feature according to one variant of the embodiment and either the first feature or the second feature according to another variant of the embodiment.

REFERENCE NUMERALS

100 keyboard
110 circuit substrate

120 key module
125 keycap
230 guide
232 mounting portion
234 bearing portion
236 connecting portion
238 end portion
240 spring element
250 support element
252 accommodating portion
260 switch unit
270 housing
272 groove
280 contact device
554 soldering surface
574 receiving bay
582 soldering surface
731 first coupling portion
733 second coupling portion
1335 bar
1337 first arm
1339 second arm
1376 subsection
1482 fixed contact piece
1484 contactor
1486 first spring clip
1488 actuation portion
1583 first contact
1585 second contact
2371 actuation opening
2375 holding portion
2387 second spring clip
2392 auxiliary actuator
2794 attaching portion
2796 nose
2798 fixing portion
3373 deflecting portion

The invention claimed is:

1. Key module for a keyboard, wherein the key module comprises:

a guide for guiding a movement of the key module upon actuation;

a support element for supporting the guide; and a switch unit, wherein the switch unit comprises a housing and a contact device at least partially arranged in the housing for establishing electric contact upon actuation of the key module, wherein the contact device comprises a fixed contact piece with a first contact and a contactor with a first spring clip carrying a second contact, a second spring clip for producing an actuation sound and at least one actuation portion, wherein the contactor is integrally formed;

wherein the second spring clip is formed to produce the actuation sound upon rebound against the housing;

wherein the contact device comprises soldering surfaces or connector pins for attaching the switch unit to a circuit substrate of the keyboard; and wherein electrical contact between the first contact and the second contact is established in one contact point.

2. Key module according to claim 1, wherein the housing comprises an actuation opening for exposing the at least one actuation portion of the contact device and/or a deflecting portion for deflecting the second spring clip of the contact device upon the actuation of the key module, wherein the deflecting portion is formed to be inclined obliquely relative to the movement of the key module upon the actuation.

3. Key module according to claim 1, with an auxiliary actuator for actuating the contact device, wherein the housing comprises at least one holding portion for holding the auxiliary actuator, wherein the auxiliary actuator comprises at least one attaching portion for movably attaching the auxiliary actuator to the at least one holding portion of the housing and/or at least one nose for deflecting the first spring clip and/or the second spring clip of the contact device upon the actuation of the key module.

4. Key module according to claim 3, wherein the auxiliary actuator comprises at least one fixing portion for fixing the auxiliary actuator to the guide.

5. Key module according to claim 1, wherein the contact device is formed to establish the electrical contact while producing friction between the first contact and the second contact.

6. Key module according to claim 1, wherein the housing is formed of a transparent or opaque material at least in a subsection and/or as at least one lens at least in a subsection, and/or wherein the housing comprises a receiving bay for a light source, and/or wherein at least one groove is formed in the housing for receiving, in an actuated state of the key module, at least one subsection of at least one spring element for providing a reset force upon actuation of the key module.

7. Key module according to claim 1, wherein the support element comprises soldering surfaces or connector pins for attaching the support element to a circuit substrate of the keyboard, and/or wherein the support element is formed of a metal material.

8. Key module according to claim 1, wherein the guide comprises a first wing element and a second wing element, wherein each wing element comprises a bar, a first arm and a second arm, wherein the arms extend away from the bar, wherein a mounting portion is formed on the bar, wherein a first bearing portion for bearing the wing element is formed on the first arm, wherein a second bearing portion for bearing the wing element is formed on the second arm, wherein the first wing element and the second wing element are mechanically coupleable to each other, wherein at least one spring element for providing a reset force upon actuation of the key module is mountable to the mounting portion of the first wing element and the mounting portion of the second wing element, wherein a plurality of accommodating portions for accommodating the bearing portions of the wing elements are formed in the support element.

9. Key module according to claim 1, comprising at least one spring element for providing a reset force upon actuation of the key module, in particular wherein the at least one spring element is formed as a tension spring or as a compression spring.

10. Keyboard, wherein the keyboard comprises:

at least one key module according to claim 1; and a circuit substrate, wherein the at least one key module is arranged on the circuit substrate.

11. Key module according to claim 1, wherein the contact device comprises soldering surfaces for attaching the switch unit to the circuit substrate of the keyboard.

12. Key module according to claim 1, wherein the first contact and the second contact are each elongated and a contact area of the first contact crosses with a contact area of the second contact such that the one contact point is established.

13. Key module according to claim 12, wherein the first spring clip extends along a longitudinal axis;

the contact area of the first contact extends obliquely with respect to the longitudinal axis of the first spring clip; and the contact area of the second contact extends obliquely with respect to the longitudinal axis of the first spring clip.

* * * * *